US010919167B2

(12) United States Patent
Park et al.

(10) Patent No.: US 10,919,167 B2
(45) Date of Patent: Feb. 16, 2021

(54) RAZOR

(71) Applicant: DORCO CO., LTD., Seoul (KR)

(72) Inventors: Young Ho Park, Seoul (KR); Jae Joon Lee, Seoul (KR); Sung Hee Son, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 16/434,476

(22) Filed: Jun. 7, 2019

(65) Prior Publication Data

US 2019/0375123 A1 Dec. 12, 2019

(30) Foreign Application Priority Data

Jun. 7, 2018 (KR) ..... 10-2018-0065428

(51) Int. Cl.
*B26B 21/40* (2006.01)
*B26B 21/52* (2006.01)
(Continued)

(52) U.S. Cl.
CPC ..... *B26B 21/4031* (2013.01); *B26B 21/405* (2013.01); *B26B 21/4018* (2013.01);
(Continued)

(58) Field of Classification Search
CPC . B26B 21/4031; B26B 21/4018; B26B 21/38; B26B 21/443; B26B 21/405;
(Continued)

(56) References Cited

U.S. PATENT DOCUMENTS 1,298,802 A 4/1919 Sharpnack
5,398,412 A * 3/1995 Tanahashi ..... B26B 19/10 30/43.9
(Continued)

FOREIGN PATENT DOCUMENTS

EP 2617537 7/2013
KR 1020010031489 4/2001
(Continued)

OTHER PUBLICATIONS

Korean Intellectual Property Office Application No. 10-2018-0065428, Office Action dated Jun. 17, 2019, 5 pages.
(Continued)

*Primary Examiner* — Ghassem Alie
(74) *Attorney, Agent, or Firm* — Lee, Hong, Degerman, Kang & Waimey

(57) ABSTRACT

Embodiments of a razor are disclosed. According to at least one embodiment, a razor includes a handle grippable by a user, a blade housing coupled to an end of the handle, the blade housing accommodating therein one or more blades, a power generation unit mounted in the handle for generating power, a drive transmission unit configured to be driven using the power generated by the power generation unit, and a swing member disposed in front of a foremost blade among the one or more blades, to swing closer to or farther away from the one or more blades according to driving of the drive transmission unit. The razor may be realized in various ways according to embodiments disclosed.

6 Claims, 14 Drawing Sheets

(51) Int. Cl.
*B26B 21/44* (2006.01)
*B26B 21/56* (2006.01)

(52) U.S. Cl.
CPC ..... *B26B 21/521* (2013.01); *B26B 21/443* (2013.01); *B26B 21/565* (2013.01)

(58) Field of Classification Search
CPC ..... B26B 21/521; B26B 21/562; B26B 19/04; B26B 19/38; B26B 21/225; B26B 21/4062; B26B 19/28; B26B 19/12; B26B 21/4012; B26B 21/22; B26B 21/522; B26B 21/526
USPC ..... 30/50, 43.92, 43.7, 77, 84, 42, 427
See application file for complete search history.

(56) References Cited

U.S. PATENT DOCUMENTS

| | | | |
|---|---|---|---|
| 5,687,485 | A | 11/1997 | Shurtleff et al. |
| 5,761,814 | A | 6/1998 | Anderson et al. |
| 5,956,848 | A | 9/1999 | Tseng et al. |
| 5,956,851 | A | 9/1999 | Apprille et al. |
| 6,041,926 | A | 3/2000 | Petricca et al. |
| 6,052,903 | A | 4/2000 | Metcalf et al. |
| 6,185,822 | B1 | 2/2001 | Tseng et al. |
| 6,212,777 | B1 | 4/2001 | Gilder et al. |
| 6,442,839 | B1 | 9/2002 | Tseng et al. |
| 6,516,518 | B1 | 2/2003 | Garraway et al. |
| 6,612,040 | B2 | 9/2003 | Gilder |
| 6,684,513 | B1 | 2/2004 | Clipstone et al. |
| 2001/0015016 | A1* | 8/2001 | Pragt ..... B26B 21/00 30/34.2 |
| 2010/0281694 | A1* | 11/2010 | Royle ..... B26B 21/22 30/43.7 |
| 2012/0005900 | A1* | 1/2012 | Erndt ..... B26B 19/04 30/43.92 |
| 2018/0304483 | A1* | 10/2018 | Lev ..... B26B 21/526 |

FOREIGN PATENT DOCUMENTS

| | | |
|---|---|---|
| KR | 10-1068271 | 9/2011 |
| KR | 101774370 | 9/2017 |
| WO | 9828113 | 7/1998 |
| WO | 2016203326 | 12/2016 |
| WO | 2018092958 | 5/2018 |

OTHER PUBLICATIONS

European Patent Office Application Serial No. 19178689.6, Search Report dated Nov. 5, 2019, 7 pages.

* cited by examiner

RAZOR

CROSS-REFERENCE TO RELATED APPLICATION(S)

Pursuant to 35 U.S.C. § 119(a), this application claims the benefit of earlier filing date and right of priority to Korean Patent Application No. 10-2018-0065428, filed on Jun. 7, 2018, the contents of which are hereby incorporated by reference herein in its entirety.

BACKGROUND OF THE INVENTION

1. Field of the Invention

Embodiments of the present invention relate to a razor, and more particularly, to a razor capable of pushing body/facial hairs that are to be cut toward a blade at a time of cutting. Embodiments are directed to providing a smooth cutting cross-section and improving an ease of cutting.

2. Description of the Related Art

In general, a razor is constituted by a handle that a user can hold and a cartridge for cutting body/facial hairs.

Korean Patent Registration No. 1068271 discloses a technology in which a cartridge is capable of reciprocating in the direction of cutting to increase the efficiency with which body/facial hairs are cut.

Specifically, in a razor according to Korean Patent Registration No. 1068271, vibration force is applied to the razor cartridge in a vertical reciprocating movement direction (X-axis) via an eccentric cam and compression and expansion operations via two vacuum guards and provided at particular positions on a head unit housing, making the razor more economical and convenient to use in cutting the body/facial hairs. However, such implementations fail to move the body/facial hairs toward the blade for cutting, resulting in the body/facial hairs being pulled before being cut, causing user discomfort such as a tingly sensation or a pulling sensation on the skin at the time of cutting.

SUMMARY OF THE INVENTION

Therefore, embodiments of the present invention have been made in view of the above problems, and aspects of the present invention are directed to providing a razor equipped with a blade for cutting body/facial hairs, capable of pushing the body/facial hairs toward the blade for easy (or more easy) cutting, thereby preventing the body/facial hairs from being pulled before being cut, resulting in reducing of user discomfort such as a tingly sensation or a pulling sensation on the skin at the time of cutting.

The aspects of the present invention are not limited to the aspects as mentioned above, and other unmentioned aspects will be clearly understood by those skilled in the art based on the following description.

In accordance with embodiments of the present invention, the above and other aspects can be accomplished by providing a razor including a handle grippable by a user, a power generation unit mounted on the handle for generating power, a drive transmission unit configured to be driven using the power generated by the power generation unit, a blade housing coupled to an end of the handle, the blade housing accommodating therein one or more blades, and a swing member disposed in front of a foremost blade among the one or more blades, to swing closer to or farther away from the one or more blades according to driving of the drive transmission unit.

The razor may further include a guard formed in front of the swing member, such that the swing member is moveable in a space between the guard and the foremost blade among the one or more blades.

The swing member may be swung in a sliding movement thereof in front of the foremost blade among the one or more blades.

The swing member may push body/facial hairs, introduced into a space between the swing member and the foremost blade among the one or more blades, so as to be closer to the foremost blade by the sliding movement thereof.

The swing member may include a guard bar provided adjacent to the foremost blade and configured to slide closer to or farther away from the foremost blade, and a sliding bar provided between the guard bar and the drive transmission unit to linearly move the guard bar according to rotation of the drive transmission unit.

The guard bar may have a first surface facing the foremost blade, the first surface being inclined.

The guard bar may be formed to have a protruding portion on at least one end thereof, the blade housing may be formed to have a rail portion corresponding to the protruding portion, and the guard bar may be linearly moved in the blade housing as the protruding portion moves along the rail portion.

The sliding bar may be formed in a lower surface thereof to have a rotational locking space in which the drive transmission unit is accommodated and is rotated.

The drive transmission unit may include a body and an eccentric cam head provided on one end of the body, at least part of an outer surface of the eccentric cam head being formed as a curved surface and being accommodated in the rotational locking space.

The razor may further include a cartridge connector configured to interconnect the blade housing and the handle, the cartridge connector providing a pivot axis to enable pivoting of the blade housing via the drive transmission unit seated therein.

Other specific features of embodiments of the present invention are disclosed in the following detailed description and the accompanying drawings.

BRIEF DESCRIPTION OF THE DRAWINGS

The above and other objects, features and other advantages of embodiments of the present invention will be more clearly understood from the following detailed description taken in conjunction with the accompanying drawings, in which.

DETAILED DESCRIPTION

Figure 1:
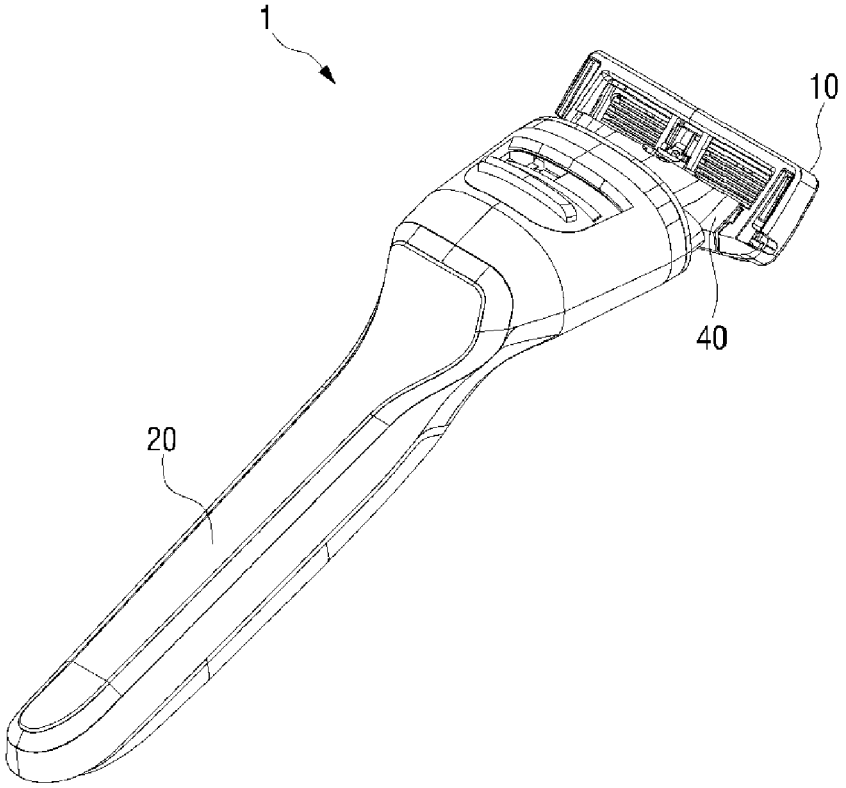
FIG. 1 is a schematic perspective view of a razor including a handle according to at least one embodiment of the present invention.

Hereinafter, various embodiments of the present invention will be described with reference to the accompanying drawings.

It should be understood, however, that there is no intent to limit the invention to the particular embodiments, but the invention is to cover various modifications, equivalents, and/or alternatives of the embodiments of the present invention. In connection with the description of the drawings, the same reference numerals will be used to refer to the same or like constituent elements.

Here, expressions such as, for example, "have", "may have", "include", and "may include", when used in this specification, specify the presence of a specific feature (e.g. a numerical value, a function, an operation, or a constituent element), but do not preclude the presence of additional features.

The terminology used herein is for the purpose of describing particular embodiments only and is not intended to limit the scope of other embodiments. As used herein, the singular forms are intended to include the plural forms as well, unless the context clearly indicates otherwise. Unless otherwise defined, all terms (including technical and scientific terms) used herein have the same meaning as commonly understood by one of ordinary skill in the art of the disclosure. It will be further understood that terms, such as those defined in commonly used dictionaries, should be interpreted as having a meaning that is consistent with or similar to their meaning in the context of the relevant art and should not be interpreted in an idealized or overly formal sense unless expressly so defined herein. In some cases, the terms defined herein may not be interpreted as excluding the embodiments of the disclosure.

Hereinafter, a razor according to at least one embodiment (e.g., an exemplary embodiment) of the present invention will be described in detail with reference to the accompanying drawings.

Figure 2A:
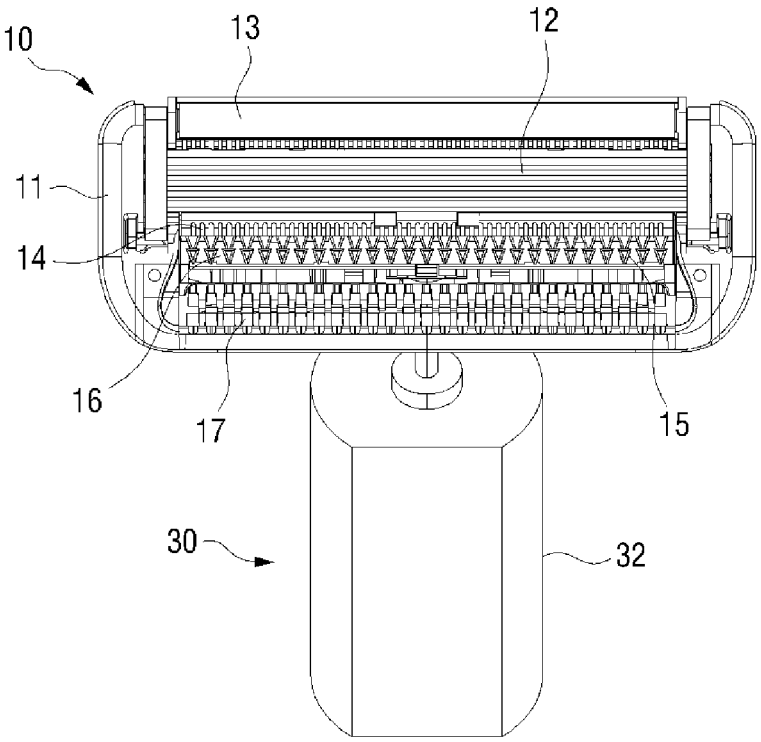
FIG. 2A is a perspective view of a razor excluding a connector according to at least one embodiment of the present invention, from a particular direction.
Figure 2B:
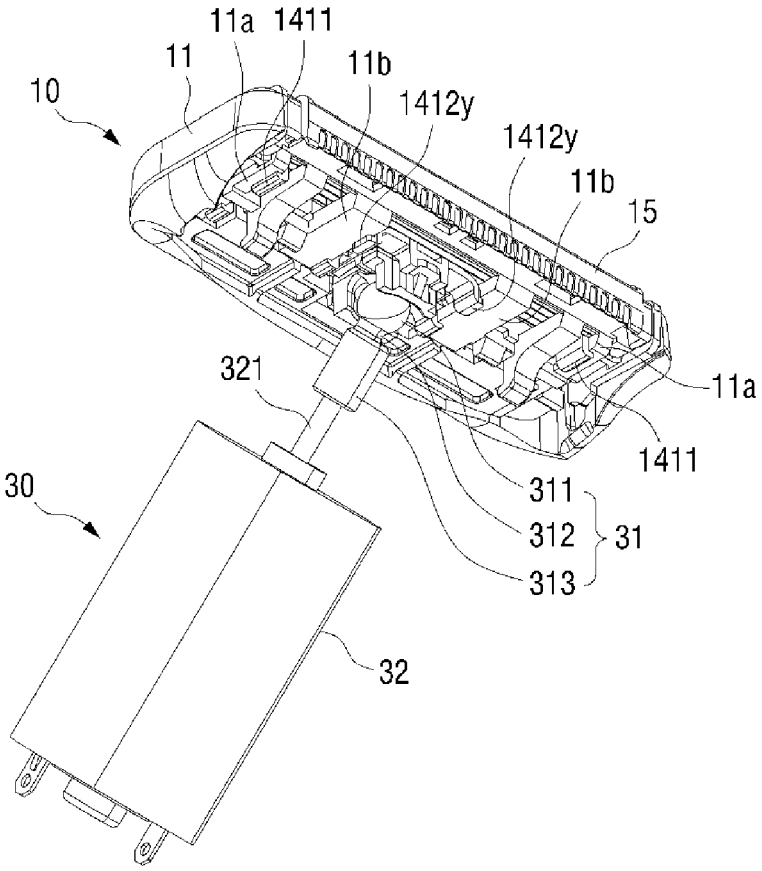
FIG. 2B is a perspective view of the razor of FIG. 2A, from a different direction.
Figure 3A:
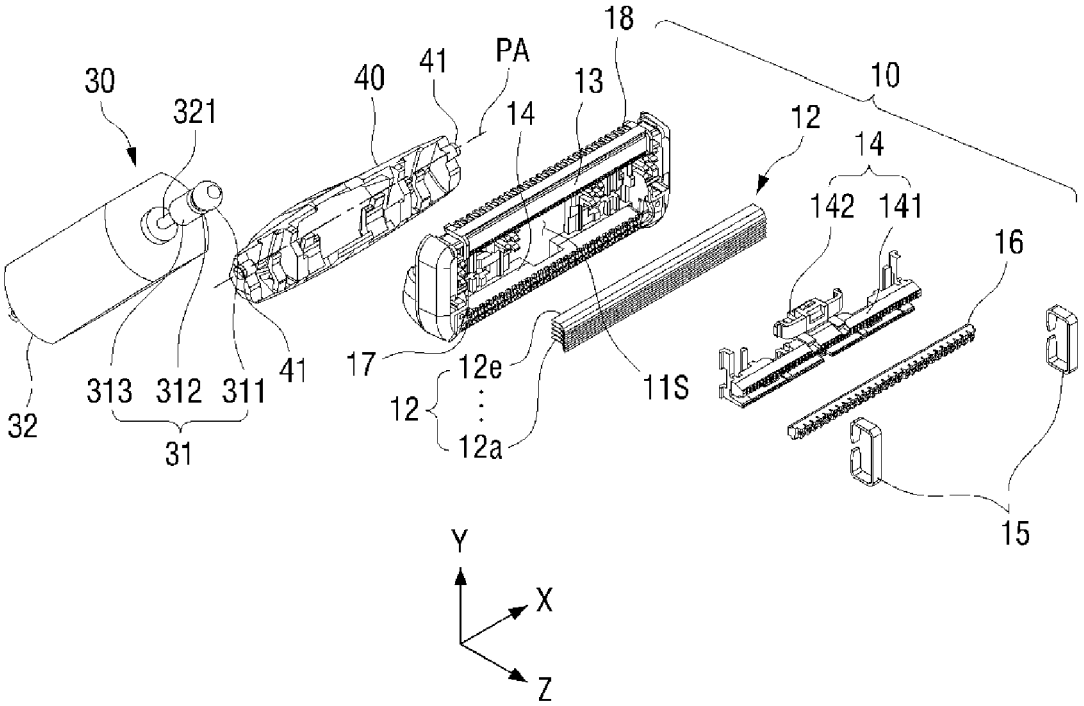
FIG. 3A is an exploded perspective view of a razor according to at least one embodiment of the present invention, from a particular direction.
Figure 3B:
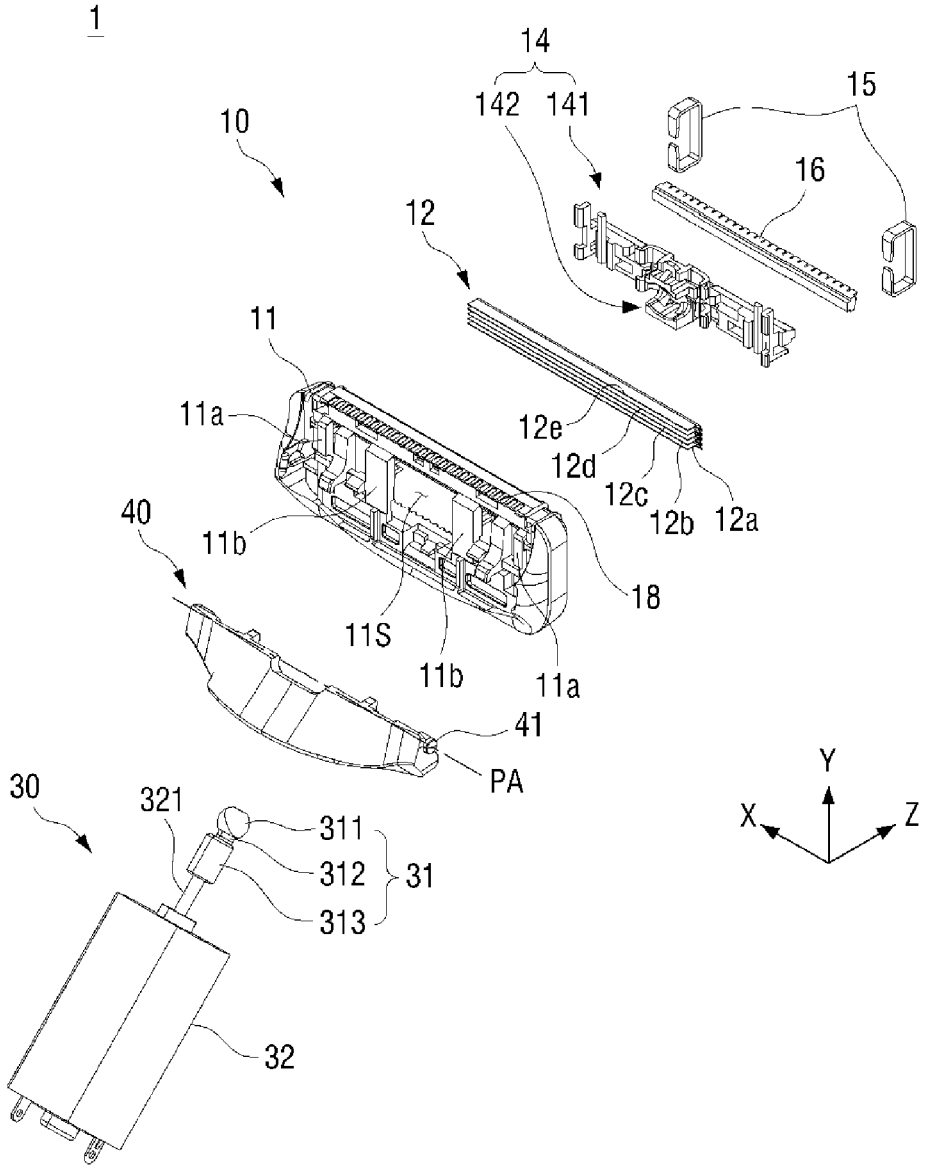
FIG. 3B is an exploded perspective view of the razor of FIG. 3A, from a different direction.

FIG. 1 is a schematic perspective view of a razor 1 including a handle according to at least one embodiment of the present invention. FIG. 2A is a perspective view of the razor 1 excluding a connector according to at least one embodiment of the present invention, from a particular direction. FIG. 2B is a perspective view of the razor 1 excluding the connector according to at least one embodiment of the present invention, from a different direction. FIG. 3A is an exploded perspective view of the razor 1 according to at least one embodiment of the present invention, from a particular direction. FIG. 3B is an exploded perspective view of the razor 1 according to at least one embodiment of the present invention, from a different direction.

Referring to FIGS. 1 to 3B, the razor 1 according to at least one embodiment of the present invention may include a handle 20, a cartridge 10 including a blade housing 11, a power unit 30 including a power generation unit 32 and a drive transmission unit 31, a swing member 14, and a cartridge connector 40. First, in the following description of the razor 1 according to at least one embodiment of the present invention, for purposes of convenience of description, the left-and-right directions of the cartridge 10 may be referred to or defined as the longitudinal directions or the X-axis direction and the opposite X-axis direction, the up-and-down directions of the cartridge 10 may be referred to or defined as the width directions or the Y-axis direction and the opposite Y-axis direction, and the front-and-rear directions of the cartridge 10 may be referred to or defined as the Z-axis direction and the opposite Z-axis direction. However, the X-, Y- and Z-axes defined above are merely used for purposes of convenience of description, and are not intended to limit the scope of the present invention.

The cartridge 10 according to at least one embodiment of the present invention may refer to an element that includes one or more constituent elements for cutting body/facial hairs while being in contact with a user's skin. For example, the cartridge 10 may include a blade 12 that cuts the body/facial hairs, the blade housing 11 that holds the blade 12, a lubrication band 13, a guard 17, and the like. According to at least one embodiment, the cartridge 10 further includes the swing member 14 for pushing the body/facial hairs to be closer to the blade 12 at the time of cutting the body/facial hairs.

According to at least one embodiment, the blade housing 11 is a constituent element of the cartridge 10, and has a surface that comes into contact with the skin. By way of example, a plurality of blades 12*a* to 12*e* (hereinafter referred to as "blades 12") that cut the body/facial hairs, the swing member 14, and the lubrication band 13 are mounted in the blade housing 11. The blade housing 11 may define therein a seating space 11S in which the plurality of blades 12, the swing member 14, and the like may be accommodated. The plurality of blades 12 and the swing member 14, which are accommodated in the seating space 11S of the blade housing 11, may be mounted so as to extend in (or along) the longitudinal direction, i.e., in the X-axis direction, and may be arranged adjacent to each other in the Y-axis direction. A pair of clips 15 may be mounted on left and right side surfaces of the blade housing 11 to support and fix the plurality of blades 12 in a state in which the blades 12 are accommodated in the seating space 11S. Although an example in which the fixing clips 15 serve to fix the plurality of blades 12 to the blade housing 11 has been described with reference to at least one embodiment, it is understood that other types of fixing devices may be used instead of the fixing clips 15.

The plurality of blades 12 are arranged parallel to each other, and edges of the plurality of blades 12 are bent, at a predetermined angle, forward (or in front) of the blade housing 11, i.e., in the opposite Y-axis direction with respect to the Z-axis direction. However, the direction in which the edges of the plurality of blades 12 are bent is not limited thereto. For example, the plurality of blades 12 may be steel strip blades or flat blades. In addition, although five blades are illustrated in the drawings, e.g., FIG. 3A, it is understood that the number of blades 12 is not limited thereto.

In addition, the guard 17, the lubrication band 13, a comb guard, a guard rubber, and the like may be provided above and below the plurality of blades 12 in the Y-axis direction of the blades 12 within the blade housing 11, and the swing member 14 may be provided adjacent to a foremost blade 12*a* among the plurality of blades 12. In other words, in the razor 1 according to at least one embodiment of the present invention, the swing member 14 may be mounted in the seating space 11S defined between the blades 12 and the guard 17. The swing member 14 will be described later in more detail with reference to FIGS. 4 to 10C. A trimmer 18 may be provided on a tile surface of the blade housing 11. The trimmer 18 may be fixed to the blade housing 11 via a separate fastening structure thereof, or may be fixed to the blade housing 11 via a fixing member such as an adhesive member.

The lubrication band 13 may supply a certain material, containing a lubricating component and a skin soothing component, to skin that comes into contact with the blade housing 11 during shaving, thereby serving to make (or help) the blade housing 11 smoothly move while being in close contact with the skin and to soothe the skin. Alternatively, a guard rubber formed of an elastic material may be provided at the position (or location) of the lubrication band 13 (see, e.g., FIGS. 3A and 3B) instead of the lubrication band 13.

The guard 17 may be formed of an elastic member or any other material such as plastic. The guard 17 is generally attached or coupled to the front or rear of the blade housing 11, but embodiments of the present invention are not limited thereto. The guard 17 and the blade housing 11 may be integrally formed with each other. The guard 17 may take the form of a comb guard or a guard rubber, or may be configured such that a comb guard or a guard rubber is additionally mounted on a front portion of the guard 17 with respect to the Z-axis direction. The swing member 14 may be disposed adjacent to the guard 17, as will be described in more detail later.

The configurations of the guard 17, the trimmer 18, the guard rubber, the lubrication band 13, and the comb guard are not limited to the above description. For example, the lubrication band 13, the guard rubber, and the comb guard may be disposed anywhere in the upper region or the lower region of the blade housing 11 and may be disposed so as to overlap each other, or may not be disposed in the blade housing 11. That is, the configurations of the lubrication band 13, the guard rubber, the comb guard, and the trimmer 18, for example, may be changed or modified in any of various ways according to, for example, the type, shape, and use of the razor 1.

According to at least one embodiment, the handle 20 is an element that the user can hold with his (or her) hand and may be coupled to a surface of the cartridge 10. Since the razor 1 is generally used in a humid environment, the handle 20 may be formed of a material that does not easily corrode even if it is frequently exposed to moisture, and provides a feeling of a stable grip to the user. For example, the material may be synthetic rubber or plastic, but it is understood that the material of the handle 20 may be changed or modified in any of various ways.

According to at least one embodiment, the cartridge connector 40 may be provided between the cartridge 10 and the handle 20 to interconnect the handle 20 and the cartridge 10. The cartridge connector 40 may provide (or define) a pivot axis PA, which is created by interconnecting bosses 41 formed on both side surfaces of the cartridge connector 40. The drive transmission unit 31 of the power unit 30, which will be described in more detail later, may be seated in an inner space of the cartridge connector 40. As such, the drive transmission unit 31 may be covered with the cartridge connector 40 and, thus, exposure of the drive transmission unit 31 to the outside (or the exterior environment) may be limited.

Figure 4:
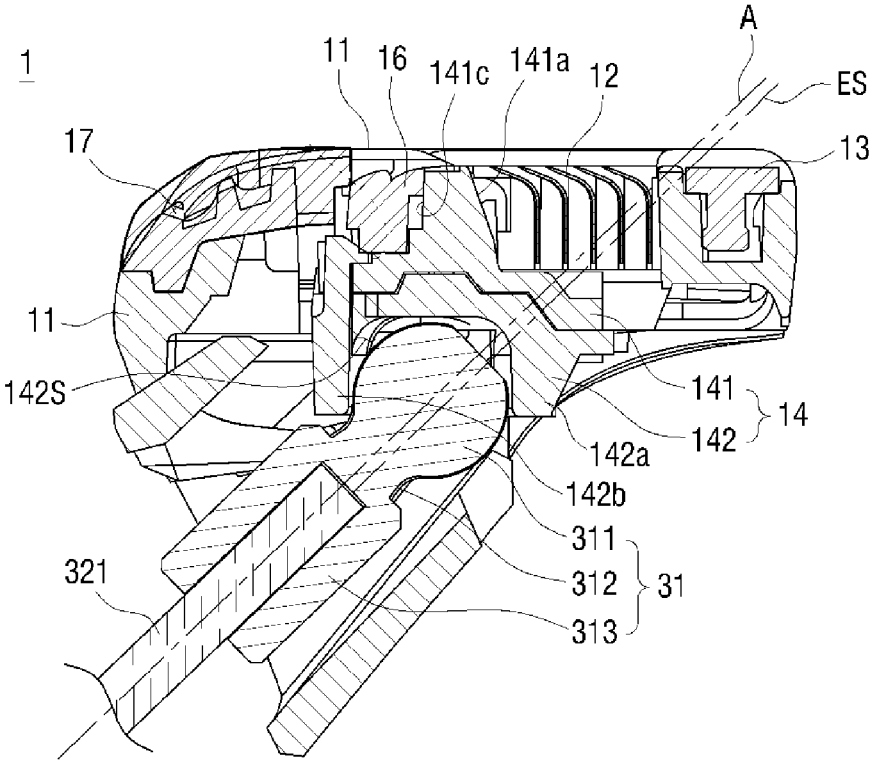
FIG. 4 is a schematic cross-sectional view of a razor according to at least one embodiment of the present invention.

FIG. 4 is a schematic cross-sectional view of the razor 1 according to at least one embodiment of the present invention.

Referring to FIGS. 1 to 3B as well as FIG. 4, according to at least one embodiment, the power unit 30 may be provided inside the handle 20, and may serve to transmit (or transfer) a drive force to the cartridge 10, more particularly, to the swing member 14, as will be described in more detail later. The swing member 14 may be swung, by (or in) a sliding movement thereof, closer to or farther away from the blade 12 according to the driving of the power unit 30.

According to at least one embodiment, the power unit 30 may be seated inside the handle 20 to transmit power for driving the swing member 14, as will be described in more detail later. The power unit 30 may include the power generation unit 32 and the drive transmission unit 31.

According to at least one embodiment, the power generation unit 32 may be mounted in the handle 20, and may serve to generate power for driving the swing member 14. For example, the power generation unit 32 may be a motor. However, it is understood that, in addition to the motor that performs rotation, the power generation unit 32 may include any of various devices capable of generating repetitive movement, such as a solenoid that performs linear movement, and the configuration of the power generation unit 32 may be changed or modified in any of various ways as long as the power generation unit 32 provides a drive force for driving the swing member 14. The power generation unit 32 may be provided at one end thereof with a shaft 321, which forms (or defines) a rotation axis A for transmitting the rotation of the motor to the drive transmission unit 31. The motor may rotate the shaft 321 (of the power generation unit 32 or of the motor) upon receiving external power. The rotation axis A of the shaft 321 may be coincident with the center axis of the motor.

According to at least one embodiment, the drive transmission unit 31 may protrude from one end of the power generation unit 32 so as to be rotatable and/or be linearly movable, and may transmit (or transfer) the power generated by the power generation unit 32 to the swing member 14.

In at least one embodiment of the present invention, the drive transmission unit 31 may be rotated by the power received from the power generation unit 32, and may be eccentric with respect to the rotation axis A. Accordingly, the drive transmission unit 31 may transmit the power, generated by the power generation unit 32 via rotation and/or linear movement thereof, for example, to the swing member 14, to cause the swing member 14 to be linearly moved, as will be described in more detail later. An example in which the swing member 14, which is connected to and driven by the drive transmission unit 31, is linearly moved due to the eccentricity of the drive transmission unit 31 has been described with reference to at least one embodiment. However, it is understood that embodiments of the present invention are not limited thereto. For example, in addition to the eccentric structure, the structure of the drive transmission unit 31 may be changed or modified in any of various ways as long as the drive transmission unit 31 causes the swing member 14 to be linearly moved closer to or farther away from the blade 12 upon receiving the drive force of the power generation unit 32.

The drive transmission unit 31, which may have an eccentric structure as described earlier, may take the form of an eccentric cam, for example. The drive transmission unit 31 may include an eccentric cam head 311 and an eccentric cam body 313, and may further include an eccentric cam neck 312 that interconnects the eccentric cam head 311 and the eccentric cam body 313.

The eccentric cam head 311 may be rotated by the power transmitted from the power generation unit 32, more particularly, the motor. A center axis ES of the eccentric cam head 311 may be eccentric and parallel to the rotation axis A of the motor, more particularly, the shaft 321, and may be spaced apart therefrom by a predetermined distance. Since the center axis ES of the eccentric cam head 311 is spaced apart from the rotation axis A of the shaft 321 by the predetermined distance to have eccentricity, when the eccentric cam head 311 is rotated, the swing member 14, may be linearly moved or oscillated by the eccentric cam head 311, as will be described in more detail later. In addition, in at least one embodiment of the present invention, the amplitude of the linear movement of the swing member 14 may be changed according to a change in the distance between the center axis ES of the eccentric cam head 311 and the rotation axis A. One end of the eccentric cam head 311 may be connected to the eccentric cam body 313, and the other end of the eccentric cam head 311 may come into contact with the swing member 14, more particularly, a sliding bar 142 of the swing member 14, as will be described in more detail later. In at least one embodiment, the eccentric cam head 311 may take the form of a sphere having a predetermined curvature. Although an example in which the entire eccentric cam head 311 takes the form of a sphere having a predetermined curvature has been described with reference to at least one embodiment, embodiments of the present invention are not limited thereto. For example, the eccentric cam head 311 may take the form of a hemisphere, one end of which is connected to the eccentric cam body 313, and a semispherical portion of the eccentric cam body 311 may come into contact with the sliding bar 142. Accordingly, the shape of the eccentric cam head 311 may be changed or modified in any of various ways as long as the eccentric cam head 311 may come into contact with the sliding bar 142 to drive the sliding bar 142, e.g., to linearly move the swing member 14.

The eccentric cam body 313 may be connected to the shaft 321, which protrudes from one end of the power generation unit 32, more particularly, the motor, and may transmit (or transfer) the power generated by the power generation unit 32 to the eccentric cam head 311 to rotate the eccentric cam head 311. A center axis of the eccentric cam body 313 may be coincident with the rotation axis A of the power generation unit 32, more particularly, the shaft 321.

The eccentric cam neck 312 may be connected to the eccentric cam body 313 and to the eccentric cam head 311. In at least one embodiment, the eccentric cam neck 312 may be connected to one side of the eccentric cam body 313, and may be eccentrically connected to the eccentric cam body 313. That is, the center axis EA of the eccentric cam neck 312 may be spaced apart from the rotation axis A of the eccentric cam body 313 by a predetermined distance. Accordingly, the eccentric cam neck 312 may be eccentrically rotated around the rotation axis A of the shaft 321 according to the driving of the power generation unit 32.

Although an example in which the eccentric cam body 313 and the eccentric cam head 311 are connected to the eccentric cam neck 312 has been described with reference to at least one embodiment, it is understood that various modifications or changes are possible. For example, the eccentric cam neck 312 may not be provided, and the eccentric cam head 311 and the eccentric cam body 313 may be directly connected to each other.

Figure 5A:
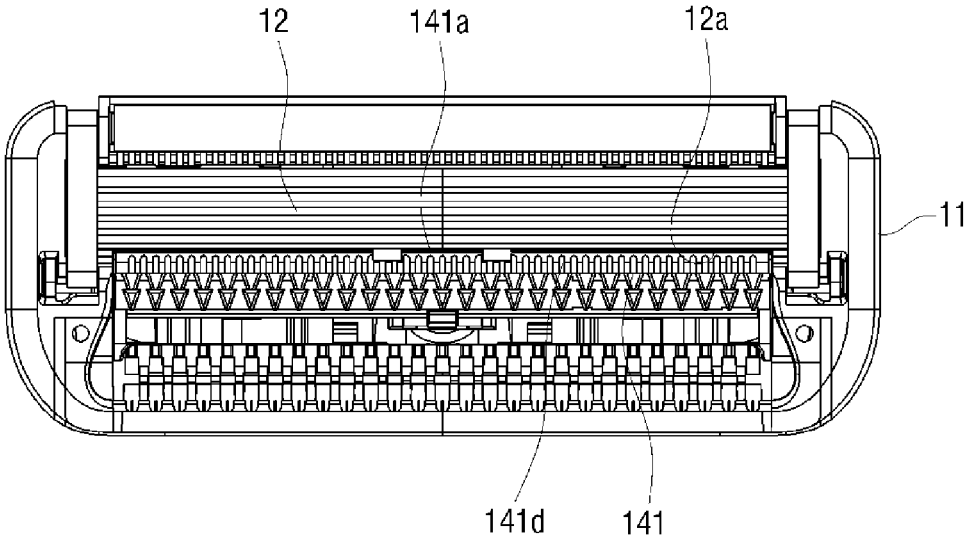
FIG. 5A is a perspective view schematically illustrating a state in which a swing member accommodated in a blade housing is located closest to a foremost blade in a razor according to at least one embodiment of the present invention.
Figure 5B:
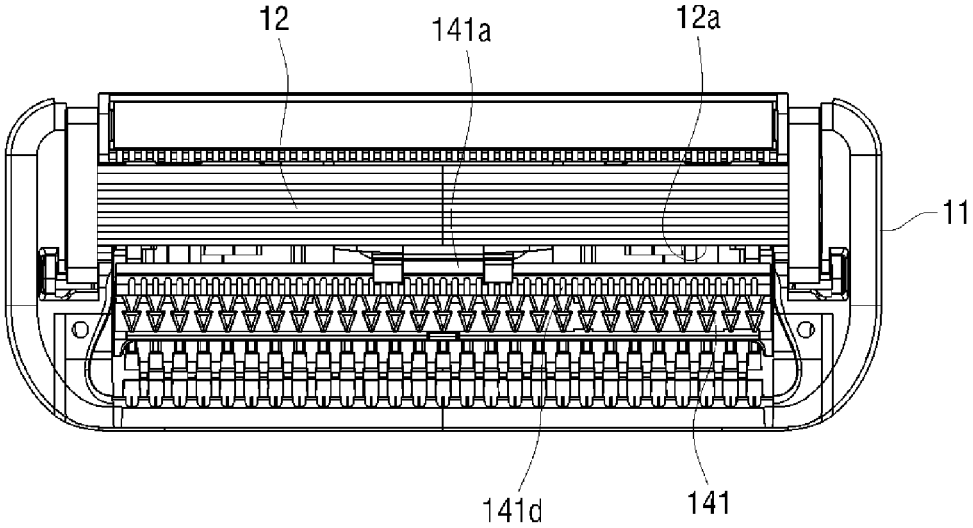
FIG. 5B is a perspective view schematically illustrating a state in which the swing member accommodated in the blade housing is located farthest from the foremost blade in the razor according to at least one embodiment of the present invention.
Figure 6:
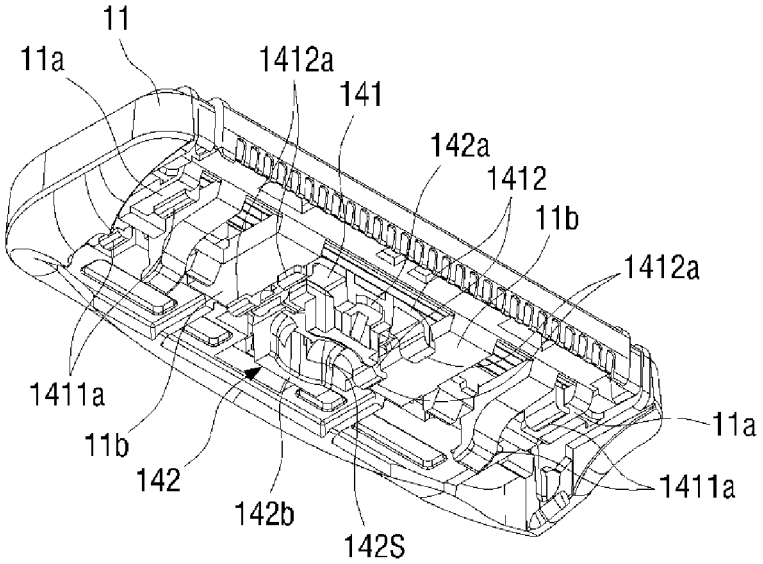
FIG. 6 is a perspective bottom view schematically illustrating the swing member accommodated in the blade housing in the razor according to at least one embodiment of the present invention.
Figure 7:
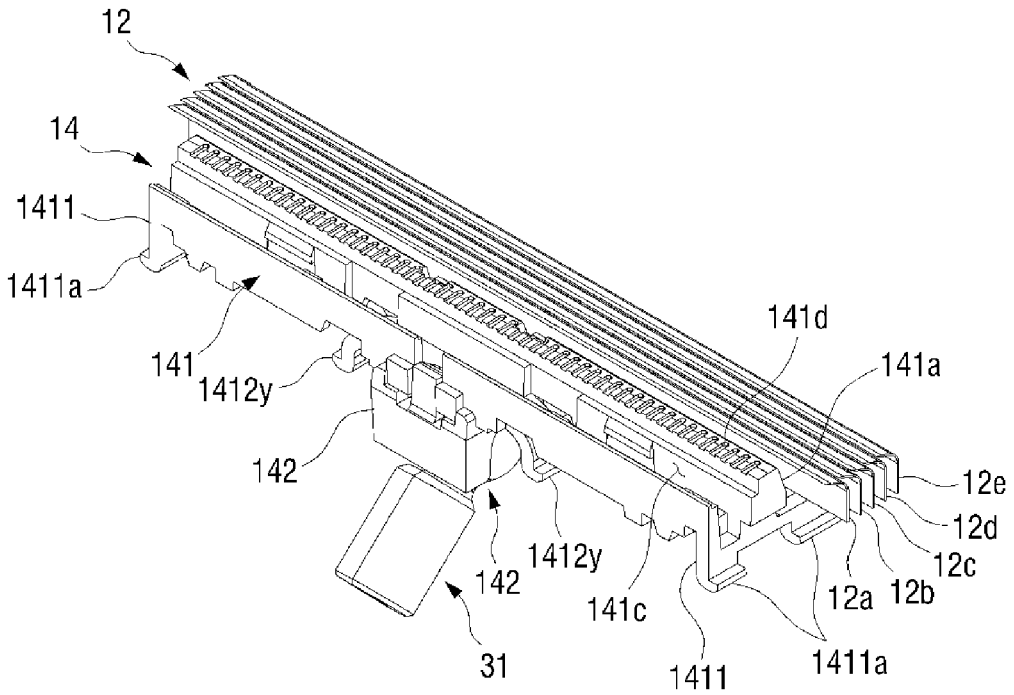
FIG. 7 is a perspective view schematically illustrating a state in which the swing member, the blade, and a drive transmission unit are coupled to each other in the razor according to at least one embodiment of the present invention.

FIG. 5A is a perspective view schematically illustrating a state in which the swing member 14 accommodated in the blade housing 11 is located closest to the foremost blade in the razor 1 according to at least one embodiment of the present invention. FIG. 5B is a perspective view schematically illustrating a state in which the swing member 14 accommodated in the blade housing 11 is located farthest from the foremost blade in the razor 1 according to at least one embodiment of the present invention. FIG. 6 is a perspective bottom view schematically illustrating the swing member 14 accommodated in the blade housing 11 in the razor 1 according to at least one embodiment of the present invention. FIG. 7 is a perspective view schematically illustrating a state in which the swing member 14, the blade 12, and the drive transmission unit 31 are coupled to each other in the razor 1 according to at least one embodiment of the present invention.

Referring to FIGS. 5A to 7 as well as FIGS. 3A and 3B and FIG. 4, according to at least one embodiment, the swing member 14 may be mounted in the seating space 11S of the blade housing 11 and may be disposed in front of the blade 12, more particularly, the foremost blade 12*a* among the plurality of blades 12.

A surface of the swing member 14, for example, the upper surface of the swing member 14 may be exposed to come into contact with or be close to the skin, and may be structured so as to come into contact with the body/facial hairs and push the body/facial hairs closer to the blade 12. Some of the body/facial hairs, which are pushed closer to the blade 12 by the swing member 14, may be erected in (or caused to extend along) a direction substantially perpendicular to the surface of the skin. In addition, another surface of the swing member 14, for example, the lower surface of the swing member 14 may be coupled to the power unit 30, more particularly, the drive transmission unit 31.

The swing member 14 may be oscillated or swung while sliding closer to or farther away from the foremost blade 12*a*, i.e., in the Y-axis direction and the opposite Y-axis direction (see, e.g., FIGS. 3A and 3B) between the blade 12, more particularly, the foremost blade 12*a* and the guard 17 in the seating space 11S of the blade housing 11 according to the eccentric driving of the drive transmission unit 31. Initially, some body/facial hairs may lay flat as the hairs are introduced into (or caused to meet) the blade, due to contact between the blade housing 11 and the skin. As the swing member 14 is oscillated or swung by (or in) a sliding movement thereof in the Y-axis direction and the opposite Y-axis direction, the swing member 14 may push the body/facial hairs and may erect some of the body/facial hairs, in (e.g., cause the hairs to extend along) a direction substantially perpendicular to the surface of the skin. That is, in a space between the swing member 14 and the foremost blade 12*a*, the body/facial hairs may be pushed to the foremost blade 12*a* as the swing member 14 is oscillated or swung by (or in) a sliding movement thereof in the Y-axis direction and the opposite Y-axis direction, and some of the body/facial hairs may be introduced into (or caused to meet) the blade as they are erected in (or caused to extend along) a direction substantially perpendicular to the surface of the skin.

In at least one embodiment of the present invention, through the vibration of the swing member 14, the swing member 14 pushes the body/facial hairs toward the foremost blade 12*a*, and some of the body/facial hairs introduced into the seating space 11S are moved to the blade as they are erected in a direction substantially perpendicular to the surface of the skin. When the swing member 14 is stationary and located at a position away from (e.g., far away from) the foremost blade 12*a*, the distance between the swing member 14 and the foremost blade 12*a* may range from 0.4 mm to 2.0 mm, more particularly, from 0.5 mm to 1.6 mm. At the time the swing member 14 is moving, the distance between the edge of the foremost blade 12*a* and the swing member 14 may range from 0 mm to 2.3 mm. However, it is understood that the distance between the swing member 14 and the foremost blade 12*a* is not limited thereto, and may be changed according to the shape or form of the swing member 14. The distance may also be changed according to the shape of the foremost blade 12*a*, for example, according to whether the blade 12 is bent or is formed of a steel strip.

In addition, the swing member 14 may provide not only a function of pushing the body/facial hairs closer to the blade 12 as the swing member is swung, but also additional functions. For example, the swing member 14 may be provided with a sub lubrication member for providing a lubricant, may be provided with a sub comb guard having a plurality of protrusions or grooves or comb-shaped protrusions or grooves formed on an upper surface thereof for the alignment of body/facial hairs, or may be provided with a guard rubber to push the skin more easily. In addition, the swing member 14 may be formed of any of various materials. For example, the swing member 14 may be formed of the same material as or a different material from the blade housing 11. In addition, the swing member 14 may include a rubber material for erecting some of the body/facial hairs and moving the body/facial hairs toward the blade 12 in order to provide (or effect) a predetermined pulling force to facilitate ease in cutting.

The swing member 14 may be configured such that a lower surface portion and an upper surface portion of the swing member 14 are formed integrally with or separately from each other. The lower surface portion slides while being coupled to the drive transmission unit 31, and the upper surface portion slides to push the body/facial hairs toward the blade 12. Although an example in which the upper surface portion ("guard bar 141" to be described in more detail later) and the lower surface portion ("sliding bar 142" to be described in more detail later) of the swing member 14 are integrally formed with each other has been described with reference to at least one embodiment, it is understood that these portions may be formed separately from each other according to the shape, manufacturing method, and manufacturing process of the swing member 14, for example. Here, the term "integrally" may refer to a configuration in which two or more elements are not separated from each other and define a singular shape without a separate coupling member or a coupling structure. In the case in which the swing member 14 has an integral structure, the swing member 14 may be formed of a single material and may have a singular shape, without a limitation thereto. However, it is understood that various other modifications or changes are possible. For example, elements of different materials may be formed integrally with each other by injection molding or die casting so as not to be separated from each other, and to define a singular shape.

According to at least one embodiment of the present invention, the swing member 14 is integrally formed, but may exert (or facilitate) two functions of the guard bar 141 and the sliding bar 142.

The guard bar 141 is formed longitudinally in the X-axis direction between the guard 17 and the foremost blade 12*a* in the seating space 11S and is configured to be swung. The guard bar 141 may serve to push the body/facial hairs toward the blade 12 when swung.

The sliding bar 142 may be disposed beneath a lower center portion of the guard bar 141, or may be disposed in a lower region of the blade housing 11 without the guard bar 141. The sliding bar 142 may linearly slide the guard bar 141 upon receiving the drive force of the power unit 30.

The guard bar 141 and the sliding bar 142 may be integrally formed of the same material, or may be integrally formed of different materials by double-shot injection molding or the like. For example, the guard bar 141 and the sliding bar 142 may be formed of a rubber material having predetermined elasticity. Alternatively, the guard bar 141 may be formed of a rubber material, and the sliding bar 142 may be formed of a plastic material. Although the guard bar 141 and the sliding bar 142 have been described as being formed of a rubber material or a plastic material, it is understood that the material of the guard bar 142 and the sliding bar 142 may be changed or modified in any of various ways.

Figure 8:
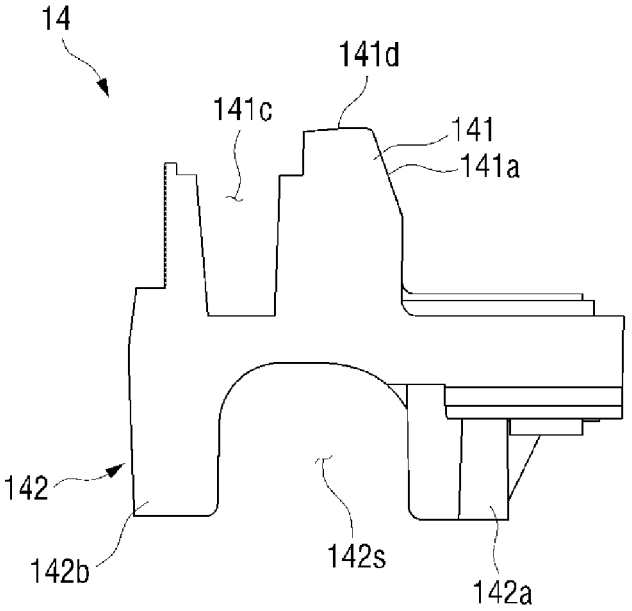
FIG. 8 is a cross-sectional view of the swing member in the razor according to at least one embodiment of the present invention.

FIG. 8 is a cross-sectional view of the swing member in the razor according to at least one embodiment of the present invention.

Referring to FIG. 8, the guard bar 141 may be disposed adjacent to the foremost blade 12*a*, and may be accommodated in the seating space 11S so as to extend in (or along) the same direction as the blade 12, i.e., in the longitudinal direction. The sliding bar 142 may linearly slide the guard bar 141 to be closer to or farther away from the foremost blade 12*a*.

A plurality of grooves 141*d* in the form of a comb guard may be formed in the upper surface of the guard bar 141 in a direction in which the body/facial hairs is cut, e.g., in the Y-axis direction for pushing the body/facial hairs toward the blade 12, erecting some of the body/facial hairs, or aligning the body/facial hairs to be introduced into (or caused to meet) the blade 12. In addition, an accommodating groove 141*c* may be formed in the guard bar 141 in the X-axis direction, and a sub module 16 (see, e.g., FIGS. 10A, 10B and 10C) may be mounted in the accommodating groove 141*c* for aligning the body/facial hairs in the accommodating groove 141*c*, providing a lubricant, or pulling the body/facial hairs. For example, the sub module 16 may be a sub rubber guard or a sub comb guard that is capable of pulling or aligning the body/facial hairs. Alternatively, the sub module 16 may be further provided with a sub lubrication band. The sub module 16 may be formed of the same material as or a different material from the guard bar 141, and it is understood that the material of the sub module 16 may be changed or modified in any of various ways according to the function or role of the sub module 16. For example, the sub module 16 may be a sub comb guard or a sub guard that is formed of a rubber material or a plastic material. Although an example in which the guard bar 141 having the accommodating groove 141*c* and the sub module 16 is mounted in the accommodating groove 141*c* has been described with reference to at least one embodiment, it is understood that various modifications or changes are possible. For example, the sub module 16 may be selectively mounted and the guard bar 141 may not be formed with (or to have) the accommodating groove 141*c*.

In at least one embodiment of the present invention, the guard bar 141 may have a first surface 141*a*, which is adjacent to and faces the foremost blade 12*a*, and the first surface 141*a* may be vertically formed or may have a predetermined inclination. In one example, the first surface 141*a* may be vertically formed. In this case, the body/facial hairs, which would otherwise be introduced into (or caused to meet) the blade 12 while lying flat in the shaving direction due to the contact between the blade housing 11 and the skin, may be pushed toward the blade 12 and be erected in the direction perpendicular to the surface of the skin by the upper surface of the guard bar 141 and the first surface 141*a*. In another example, the first surface 141*a* may be formed to have a predetermined inclination. In this case, it may be possible to more easily erect the lying body/facial hairs by the surface 141*a*, compared to the case in which the first surface 141*a* is vertically formed. An example in which the first surface 141*a* is inclined has been described with reference to at least one embodiment, but it is understood that embodiments of the present invention are not limited thereto. For example, the first surface 141*a* may be formed to have a predetermined curvature or may be inclined with a predetermined curvature, in order to more easily push, erect, or pull the body/facial hairs and to facilitate cutting of the body/facial hairs introduced into the blade 12.

The guard bar 141 may be provided on opposite ends of the lower surface thereof with (or to have) protruding portions 1411, which may be caught by and fixed to the blade housing 11, and may guide the sliding movement of the swing member 14 in the blade housing 11.

The protruding portions 1411 may be formed in the width direction, i.e., in the Y-axis direction on opposite side surfaces of the guard bar 141, and may respectively have fixing hooks 1411*a*, which are bent and protrude toward the blade housing 11. The blade housing 11 may be provided on opposite sides of the lower surface thereof with rail portions 11*a*, which extend longitudinally in the Y-axis direction, so that the fixing hooks 1411*a* are caught by the respective rail portions 11*a*. In at least one embodiment, the rail portion 11*a* may take the form of a fixing bar so that the fixing hook 1411*a* is caught by the rail portion 11*a*, and the linear movement of the fixing hook 1411*a* is guided in the Y-axis direction and the opposite Y-axis direction by the rail portion 11*a*. In addition, the fixing bar may be formed with (or to have) a latching recess having a predetermined shape to realize the movement of the fixing hook 1411*a* in a state in which the end of the fixing hook 1411*a* is caught by the fixing bar. An example in which the rail portions 11*a*, which take the form of fixing bars, are formed on opposite sides of the lower surface of the blade housing 11 so that the fixing hooks 1411*a*, which are bent and protrude toward the blade housing 11, may be caught by the rail portions 11*a*, has been described with reference to at least one embodiment. However, it is understood that the shape, structure, and number of fixing hooks 1411*a* and fixing bars are not limited thereto, and various modifications or changes are possible as long as the protruding portions 1411 may be caught by and fixed to the rail portions 11*a* so as to be linearly moved on the rail portions 11*a*. For example, the protruding portions 1411 and the rail portions 11*a* may be formed as cantilevers, which are engaged with each other. In addition, the protruding portions 1411 and the rail portions 11*a* may be formed of a material including rubber or a lubricant in order to facilitate the coupling and sliding movement thereof.

According to at least one embodiment, the sliding bar 142 may be provided beneath the lower center portion of the guard bar 141, so as to be coupled to the drive transmission unit 31, more particularly, the eccentric cam head 311.

According to at least one embodiment, the sliding bar 142 may include a first member 142*a* and a second member 142*b*. The sliding bar 142 may protrude from the lower center portion of the guard bar 141 to the back of the blade housing 11, i.e., in the opposite Z-axis direction. The first member 142*a* and the second member 142*b* may be formed side by side to face each other and may be spaced apart from each other by a predetermined distance. For example, the first member 142*a* and the second member 142*b* may be formed parallel to each other, and a "U-shaped" rotational locking space 142*s* may be formed in the lower surface of the sliding bar 142 by the coupling of the first member 142*a* and the second member 142*b*. The drive transmission unit 31, more particularly, the eccentric cam head 311 may be seated in the rotational locking space 142*s*. The eccentric cam head 311 may be driven between the first member 142*a* and the second member 142*b* while being in contact with the first member 142*a* and the second member 142*b*. The first member 142*a* and the second member 142*b* may be movable in the Y-axis direction and the opposite Y-axis direction, respectively. That is, when the eccentric cam head 311 is seated in the rotational locking space 142*s* and is rotated about the axis of the eccentric cam (e.g., center axis ES of the eccentric cam head 311), the first member 142*a* or the second member 142*b* comes into contact with the eccentric cam head 311 and is pushed in the Y-axis direction or in the opposite Y-axis direction. As the first member 142*a* and (or) the second member 142*b* are pushed in the Y-axis direction or in the opposite Y-axis direction, the guard bar 141 is made (or caused) to linearly slide.

In addition, the guard bar 141 may further be provided with a coupling portion 1412 on the center of the lower surface thereof at a position (or location) around the sliding bar 142. The coupling portion 1412 serves to guide the sliding movement of the swing member 14 in the blade housing 11 in cooperation with the protruding portion 1411 (see FIG. 6). However, it is understood that the coupling portion 1412 may be selectively provided, and may be modified or changed in any of various ways according to the shape or configuration of the swing member 14.

The coupling portion 1412 may be formed in the Y-axis direction, and both ends of the coupling portion 1412 may include a pair of legs 1412*y*, which are bent outward in opposite directions. The legs 1412*y* may take the form of hooks, which are bent in opposite directions and are caught by respective latching bars 11*b* formed on the blade housing 11.

Although an example in which the sliding movement of the guard bar 141 in the blade housing 11 is guided by the legs 1412*y* and the latching bars 11*b* in addition to the protruding portions 1411 and the rail portions 11*a* has been described with reference to at least one embodiment, it is understood that the structure, configuration, and number of these elements may be modified or changed in any of various ways.

Figure 9A:
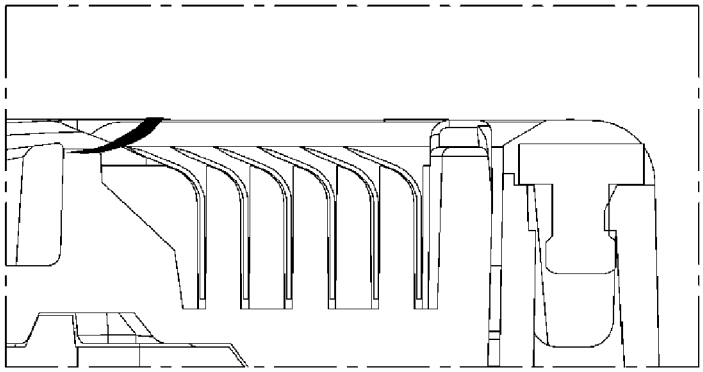
FIGS. 9A and 9B are views illustrating an operation of cutting body/facial hairs using a conventional razor.
Figure 9B:
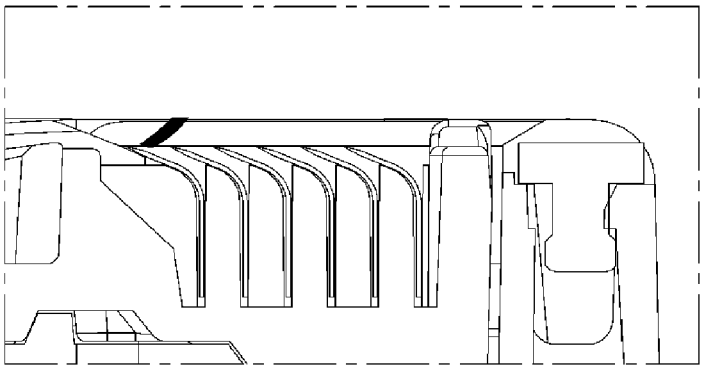
Figure 10A:
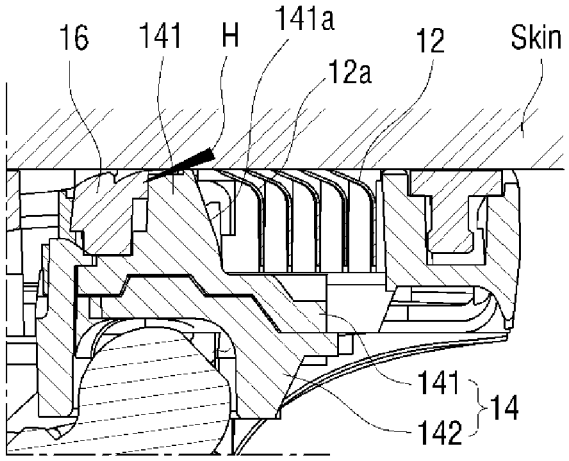
FIGS. 10A, 10B and 10C are views illustrating a driving operation of cutting body/facial hairs using a razor according to at least one embodiment of the present invention.
Figure 10B:
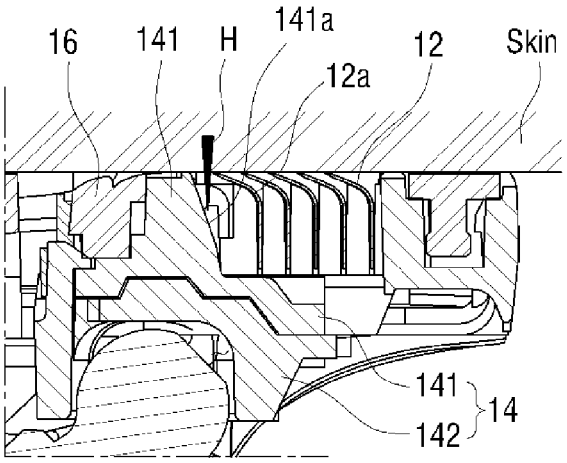
Figure 10C:
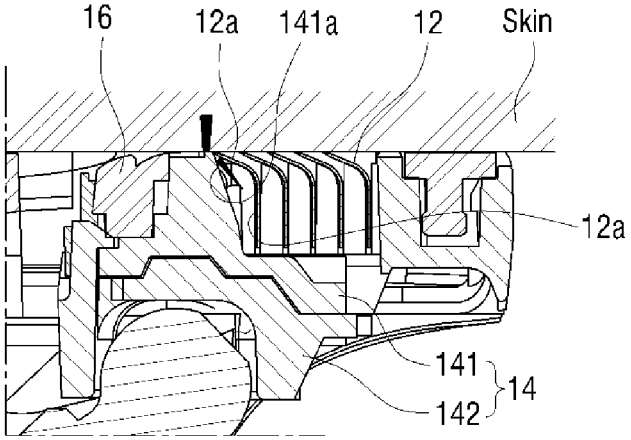
Figure 11A:
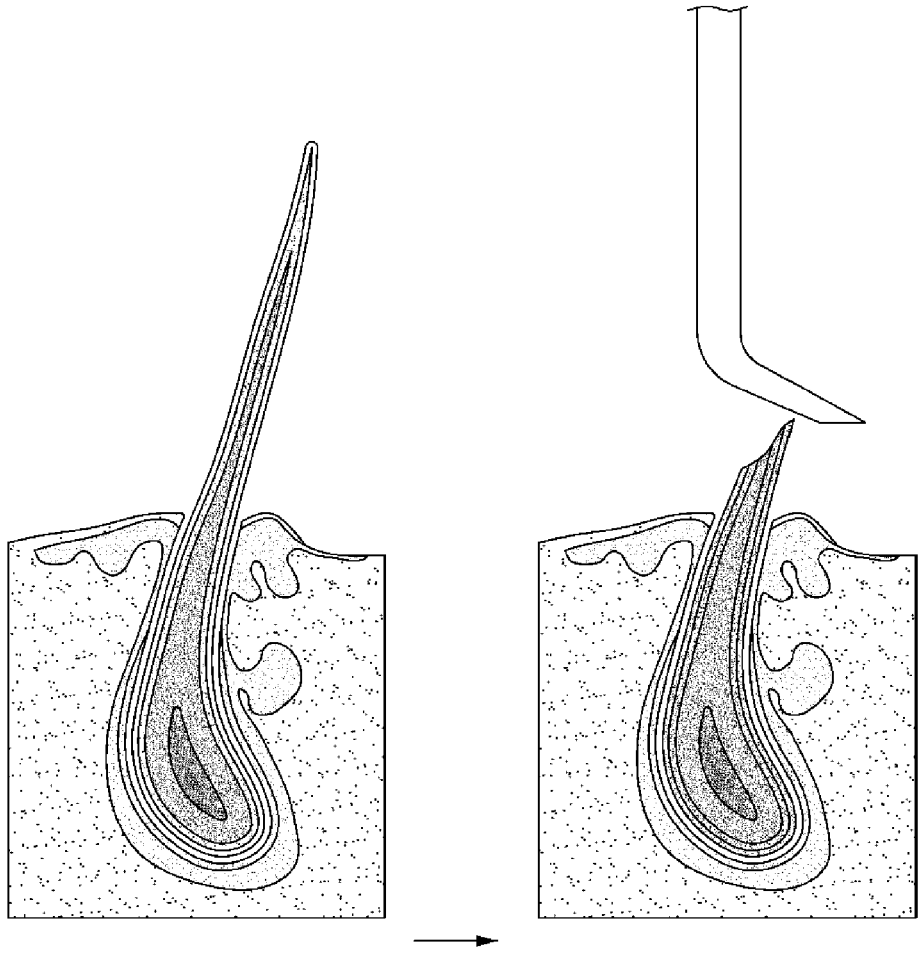
FIG. 11A is a schematic cross-sectional view of body/facial hairs cut using a conventional razor.
Figure 11B:
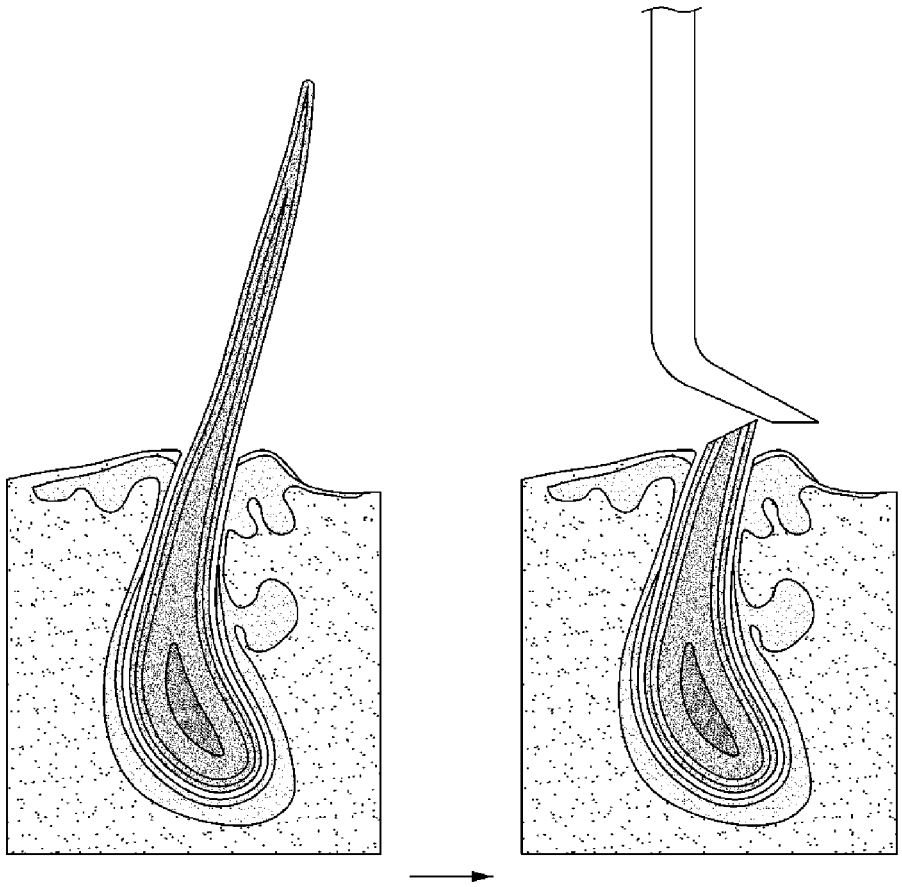
FIG. 11B is a schematic cross-sectional view of body/facial hairs cut using a razor according to at least one embodiment of the present invention.

FIGS. 9A and 9B are views illustrating an operation of cutting body/facial hairs using a conventional razor. FIGS. 10A, 10B and 10C are views illustrating a driving operation of cutting body/facial hairs using a razor according to at least one embodiment of the present invention. FIG. 11A is a schematic cross-sectional view of body/facial hairs cut using a conventional razor. FIG. 11B is a schematic cross-sectional view of body/facial hairs cut using a razor according to at least one embodiment of the present invention.

First, the cutting of body/facial hairs using a conventional razor having no swing member will be described with reference to FIGS. 9A and 9B. One surface of a blade housing may be brought into contact with the skin for the cutting of body/facial hairs. The body/facial hairs are moved toward the blade in a state of being pressed and laid flat on the skin by the force applied from the blade housing. Thereafter, as the razor is moved in the shaving direction, the body/facial hairs laid flat on the skin are pulled and cut. Therefore, the body/facial hairs may not be finely cut by the blade 12, the cross section of the cut body/facial hairs may be wide, and a so-called tugging phenomenon in which the end portion of a body/facial hair cut by the blade 12 droops and looks dirty may occur.

In contrast, the cutting of body/facial hairs in the razor 1 having the swing member 14 according to various embodiments of the present invention will be described with reference to FIGS. 10A to 10C. In the case in which body/facial hairs are cut using the razor 1 having the swing member 14, as the swing member 14 is swung, the body/facial hairs (see, e.g., hair H), which are caused to be laid flat on the skin by the blade housing 11, may be erected when being moved toward the blade. That is, as the swing member 14 is swung between the guard 17 and the foremost blade 12*a*, the body/facial hairs laid flat on the guard 17 may be erected in (or caused to extend along) the direction perpendicular to the surface of the skin by the swing member 14, more particularly, the first surface 141*a* of the swing member 14 while being moved to the foremost blade 12*a*.

The cutting of body/facial hairs in the conventional razor having no swing member and the cutting of body/facial hairs in the razor having the swing member according to various embodiments of the present invention will be compared with each other as illustrated in FIGS. 11A and 11B.

The direction in which body/facial hairs is cut in the most ideal manner may be a direction substantially perpendicular to the direction in which the body/facial hairs grow. However, as illustrated in FIG. 11A, since the body/facial hairs is cut conventionally in the state of being laid flat on the skin, the angular difference between the direction in which the body/facial hairs grow and the direction in which the body/facial hairs are cut may be inevitably small. In addition, the body/facial hair is not finely cut by the blade 12, but is cut while being forcibly pulled by the user. Therefore, it will be appreciated that the cut body/facial hairs show a large cross-sectional area and the tugging phenomenon in which the end portion of the body/facial hair cut by the blade 12 droops and looks dirty occurs.

In contrast, as illustrated in FIG. 11B, according to various embodiments of the present invention, the swing member 14 may push the body/facial hairs toward the blade 12 and may erect the body/facial hairs so that the body/facial hairs may be positioned on (or with respect to) the blade 12 so as to be cut in a more ideal (e.g., the most ideal) direction. Accordingly, the body/facial hairs to be introduced into the blade 12 may be erected in (or caused to extend along) the direction perpendicular to the blade 12, which may ensure a more ideal (e.g., the most ideal) cutting of the body/facial hairs.

As apparent from the above description, embodiments of the present invention have at least the following effects.

When cutting body/facial hairs using a razor, a swing member is swung to push the body/facial hairs, which are to be introduced into a blade, closer to the blade. This may cause the cross-sectional area of the cut body/facial hairs to be reduced at the time of cutting the body/facial hairs, and may prevent the body/facial hairs from being caught and pulled by the blade, which may prevent a user from feeling discomfort such as a tingly sensation or a pulling sensation on the skin at the time of cutting or after cutting.

The effects according to embodiments of the present invention are not limited by the content exemplified above, and various other effects may be disclosed herein.

It will be understood by those skilled in the art that the present invention may be embodied in other specific forms without departing from the spirit or essential characteristics thereof. It is therefore to be understood that the above-described embodiments are illustrative in all aspects and are not restrictive. The scope of the present invention is defined by the appended claims, rather than the above detailed description, and all changes or modifications derived from the meaning and scope of the claims and their equivalents are to be construed as being within the scope of the present invention.

What is claimed is:

1. A razor comprising:

a handle;

a blade housing coupled to an end of the handle and configured to accommodate one or more blades;

a power generation unit provided at the handle and configured to generate power;

a drive transmission unit configured to be driven using the power generated by the power generation unit; and a swing member disposed in front of a foremost blade among the one or more blades and configured to oscillate according to driving of the drive transmission unit, wherein the swing member oscillates in a sliding movement moving toward and away from the foremost blade among the one or more blades, wherein the sliding movement of the swing member is substantially perpendicular to the longitudinal axis of the foremost blade among the one or more blades, wherein, by the sliding movement, the swing member is configured to push hair introduced into a space between the swing member and the foremost blade to be closer to the foremost blade along a shaving direction, wherein the swing member comprises:

a guard bar provided adjacent to the foremost blade and configured to slide toward or away from the foremost blade; and a sliding bar provided between the guard bar and the drive transmission unit to linearly move the guard bar according to rotation of the drive transmission unit, wherein the guard bar comprises a protruding portion, wherein the blade housing comprises a rail portion corresponding to the protruding portion, and wherein the guard bar is linearly moved in the blade housing as the protruding portion is moved along the rail portion.

2. The razor according to claim 1, further comprising a guard formed in front of the swing member, such that the swing member oscillates in a space between the guard and the foremost blade among the one or more blades.

3. The razor according to claim 1, wherein the guard bar comprises a first inclined surface that faces the foremost blade.

4. The razor according to claim 1, wherein the sliding bar is formed at a lower surface of the swing member and is shaped to define a rotational locking space in which the drive transmission unit is accommodated and is rotated.

5. The razor according to claim 1, wherein the drive transmission unit comprises:

an eccentric cam body; and an eccentric cam head provided on one end of the body, wherein at least part of an outer surface of the eccentric cam head is formed as a curved surface and accommodated in a rotational locking space defined at the swing member.

6. The razor according to claim 1, further comprising a cartridge connector configured to couple the blade housing and the handle, wherein the cartridge connector corresponds to a pivot axis for pivoting of the blade housing with respect to the handle via the drive transmission unit.

* * * * *